US010357778B2

(12) United States Patent
Houchens

(10) Patent No.: US 10,357,778 B2
(45) Date of Patent: Jul. 23, 2019

(54) CLASSIFIER AND CONCENTRATOR SLUICE APPARATUS

(71) Applicant: Robert G. Houchens, Crestwood, KY (US)

(72) Inventor: Robert G. Houchens, Crestwood, KY (US)

( * ) Notice: Subject to any disclaimer, the term of this patent is extended or adjusted under 35 U.S.C. 154(b) by 0 days.

(21) Appl. No.: 15/902,941

(22) Filed: Feb. 22, 2018

(65) Prior Publication Data

US 2018/0369830 A1 Dec. 27, 2018

Related U.S. Application Data

(60) Provisional application No. 62/462,186, filed on Feb. 22, 2017.

(51) Int. Cl.
*B03B 5/26* (2006.01)
*B03B 5/56* (2006.01)
*B03B 7/00* (2006.01)

(52) U.S. Cl.
CPC ..... *B03B 5/26* (2013.01); *B03B 5/56* (2013.01); *B03B 7/00* (2013.01)

(58) Field of Classification Search
CPC ..... B03B 5/26; B03B 5/56; B03B 7/00
USPC ..... 209/458
See application file for complete search history.

(56) References Cited

U.S. PATENT DOCUMENTS

| | | | | |
|---|---|---|---|---|
| 4,319,994 | A * | 3/1982 | Morgan | B03B 5/02 209/447 |
| 5,927,509 | A * | 7/1999 | Lord | B03B 5/02 209/44 |
| 9,174,240 | B1 * | 11/2015 | Wilson | B07B 1/24 |
| 10,010,910 | B1 * | 7/2018 | Stover | B07B 1/02 |
| 2005/0183992 | A1 * | 8/2005 | Roper | B03B 5/26 209/44 |
| 2014/0117124 | A1 * | 5/2014 | Brosseuk | B03B 5/26 241/20 |

* cited by examiner

*Primary Examiner* — Terrell H Matthews
(74) *Attorney, Agent, or Firm* — David W. Carrithers; Carrithers Law Office, PLLC

(57) ABSTRACT

A classifier and concentrator sluice apparatus with recirculating water in a self contained unit for classifying, concentrating, and washing rocks, minerals, gems, and ore. The unit includes a water reservoir and water circulation system in a drum or a barrel or other container. The barrel includes an open top end and a water circulating pump and water supply lines for circulating water from the reservoir into a basin containing a colander having a selected mesh for separating aggregates by size. The tails including suspended solids and waste aggregate accumulate in the bottom of the tub for disposal.

19 Claims, 4 Drawing Sheets

CLASSIFIER AND CONCENTRATOR SLUICE APPARATUS

CROSS REFERENCES TO RELATED APPLICATIONS

This application claims priority from U.S. Provisional application Ser. No. 62/462,186 filed on Feb. 22, 2017 and is incorporated herein in its entirety.

TECHNICAL FIELD

The present invention relates to the field of separators, concentrators, and classifiers of aggregate material and searching for precious and semi-precious gems and minerals.

BACKGROUND OF THE INVENTION

Flooded rivers have a high water volume. The force of flood water is enough to pick up and carry silt, sand, gravel, and metal ore such as gold. The aggregate material is carried downstream in suspension Heavy particles such as gold bearing rock settles wherever the water slows enough to allow it to drop out of suspension. Rivers flow through channels with irregularities, rock outcropping, bends, narrow spots, wide spots, intrusions of bedrock, which causes the water to flow at different speeds along the path. Material drops out of suspension when the flow is slowed along the stream.

Various methods are employed for physically separating aggregates such as panning, rocker boxes, sluices, and hydraulic mining. All were successful but some more than others. Hydraulic mining, that is, using a powerful stream of water coming from a large, high pressure and flow hose to wash mounds or literally, hills, of dirt away from gold deposits, was very destructive of the environment. Panning, placing a small amount of dirt or aggregate into a small shallow pan and rinsing the dirt away from the gold, is quite slow and cumbersome. A rocker box was usually made from a wooden box with rockers on the bottom and a upward extending handle used to rock the box to and fro, generally included a classifier sieve or screen at the top and was lined with riffles and usually a carpet on the bottom to help catch gold particles as water washed over dirt or an aggregate sample. Modern devices often use electric or air operated equipment to shake or vibrate the sluice or classifier.

A conventional sluice comprises a trough supported at a declining angle including water flowing over a series of irregular shaped rails, ridges, or ripples whereby the aggregate is poured into the inlet of the sluice and the flow of water through the sluice provided all the energy for removing the dirt form the gold, as the water flowed over the dirt or aggregate sample placed in the sluice. Sluice boxes work by creating a straight channel with regularly spaced apart slow areas created by riffles, ridges, or other irregularities in the bottom surface. Each riffle creates an eddy consisting of a backflow of water that allows the heavier particles to settle out. Aggregate material is placed at the top of the box and carried in suspension down the channel by a flow of water. The heavier metal or minerals drop out of suspension as the water slows on the back side of the riffles. Too much water carries the gold higher in suspension because the upper layer of water is not affected by the riffles as much as the lower layer of water. The lower layer of water rolls behind the riffle whereby the upper layer of water flows over the eddy. The eddy can slow the upper layer but it is not as effective as the riffles. If the flow of water is too slow, the gold to drop out too quickly allowing lighter material to drop out and fill the space between the riffles which eliminates the slow spots allowing the gold to flow out of the sluice with the waste aggregate.

As a general rule a 1" drop is used per foot of length of your box. An acceptable flow rate allows the gold to drop out of suspension and the lighter material to flow out of the box.

Because semi-precious stones and/or minerals and/or gems are typically the same weight or lighter than the aggregate waste material, a sluice does not provide the requisite separation and concentration. Therefore, mineral or gem containing aggregate ore is typically separated using sieves or screens of a selected size and shape. Water is helpful in dissolving the silt and dirt particles carrying away the mud and washing the product gems making them reflect more light and becoming more visible to the eye of the prospector.

Individuals pan for gold and visit mining sites to look for gold, silver, precious and semi precious gems as a hobby. In order to introduce an inexperience person to the method of mining using simple separation devices, activities are often arranged by mining or rock businesses so that visitors can pan gold, minerals or gems from ore containing rock, dirt, sand, and other aggregate materials to separate any valuable products therefrom. Often a participant will purchase a bucket of aggregate ore in quantities of 1 gal or 5 gallons, and use a pan or sluice provided by the business to process the aggregate ore and experience the separation and concentration of the products. To make the experience more interesting, some businesses will premix a specific amount by weight or percent of valuable products in the aggregate ore in order to guarantee the customer will have a rewarding experience.

The present invention incorporates a classifier, concentrator, and separator sluice apparatus contained within a compact unit such as a barrel or drum using recirculated water in order that the self contained unit can be utilized inside of a building in a designated area enabling use in bad weather.

SUMMARY OF THE INVENTION

A sluice apparatus comprises a classifier, concentrator, and separator apparatus with recirculating water in a self contained unit for classifying, concentrating, and washing rocks, minerals, gems, and ore by size and density. The unit includes a water reservoir within a drum or a barrel. The barrel is inverted onto one end and includes an open top end and a selected level of water in the lower portion of the barrel. A water circulating pump mounted within the barrel in fluid communication with the water pump and an electric supply draws water from the reservoir in the barrel and pumps the water through a supply conduit from the bottom of the barrel along a peripheral edge and into a tub which sets or is removably disposed into the top of the barrel having a rim support the tub in the top of the barrel. The supply conduit includes a distal end which is positioned at a selected depth and mounted generally horizontally to circulate the water along the outer edge of the tub in the open end of the barrel wherein the rim of the tub is even with or overlaps the end edge of the barrel wall. The sides of the tub contain a plurality of spaced drain holes located in the side wall of the tub spaced depth and selected distance above the bottom floor of the tub. Water flowing out of the hose causes a circular flow around the outside of the tub. Aggregates are placed in a classifier having a selected mesh and shaken in the water to expose the product consisting of washed aggregate containing particles of a selected size. The tails including suspended solids and waste aggregate accumulate in the bottom of the tub for disposal. The product can be re-washed in classifiers of a larger mesh size to concentrate the large particles and the waste aggregate can be re-washed in classifiers having a smaller mesh to separate product therefrom.

A pressurized water nozzle spaced slightly above the plane of the tub bottom is provided with at least one jet orifices directed at the bottom adjacent the outer peripheral edge of the inner wall of the tub. The tub walls are generally sloped or conical is shape defining an inverted cone. A plurality of round holes, slots, or other openings are formed in the side walls of the tub spaced apart a selected distance from the bottom or floor of the tub and from one another and extend around the circumference of the tube at different levels.

Different tubs can be used in addition to or instead of the primary tub in order to provides tubs with different size holes, a solid tub, or tubs having irregular surfaces such as lines, dimples of swirls or grooves formed along the bottom in order to aid in separation of the ore.

The water in the wash tub is discharged through the openings in the wall and flows downward into a reservoir contained in the bottom of the barrel. A pump mounted on the outside surface or in the interior of the barrel circulates the water from the reservoir to the wash tub at a selected flow rate.

More particularly, there is provided an indoor mining kit comprising, consisting of, or consisting essentially of a barrel sitting upright on a closed end with an open end above, the barrel holding water in a bottom of the barrel at least six inches deep. The washtub is sized so that an outer rim of the washtub is supported by an outer rim of the open end of the barrel. The sidewall of the washtub has a plurality of holes formed therein and the holes are spaced apart and are at least one inch above a bottom of the washtub. The submersible water pump is submersed in the water in the bottom of the barrel and is powered by a power cord entering from the top opening of the barrel. The water hose has a first end connected in fluid communication with an outlet of the submersible pump and the second end of the water hose passes through the bottom of the washtub near an outer edge of a bottom of the washtub. The open end of the water hose is fastened near the outer edge of the bottom of the washtub and horizontally along a bottom of the sidewall of the washtub. At least one classifier is included for further searching through the aggregate.

The present invention includes a kit for providing entertaining activity, using a source of flowing water wash dirty ore aggregate, remove the contaminant to mine for gold, consisting of a barrel sitting on a first closed end, an open at the top, with water filling the lower fifth of the barrel, a water circulating pump which draws water from the bottom and pumps the water through an approximately three quarter inch rubber hose into the bottom of a small washtub which sits in the open end of the barrel. The sides of the washtub contain a plurality of evenly spaced drainage holes located in the side wall of the wash tub located at least one inch above the bottom of the wash tub. The open end of the hose passes through the bottom of the wash tub and is fastened against the bottom of the inside of the wall of the washtub so that water flowing out of the hose causes a circular flow around the wall of the washtub. Aggregate which has been collected can be placed in the washtub so that the flowing water helps to wash the aggregate away from the hidden gold. A cullender is included in the kit to collect aggregate samples for further searches.

It is an object of this invention to provide a self contained gold mining classifier, separator, and/or concentrator including a barrel, a washtub with drainage holes, and a recirculating pump causing water to swirl around the outside walls of the washtub.

It is an object of this invention to provide a self contained gold mining classifier, separator, and/or concentrator as described above and further including at least one classifier for further separation of dirt or aggregate from gold particles.

Other objects, features, and advantages of the invention will be apparent with the following detailed description taken in conjunction with the accompanying drawings showing a preferred embodiment of the invention.

BRIEF DESCRIPTION OF THE DRAWINGS

A better understanding of the present invention will be had upon reference to the following description in conjunction with the accompanying drawings in which like numerals refer to like parts throughout the views wherein.

DESCRIPTION OF THE PREFERRED EMBODIMENTS

Figure 1:
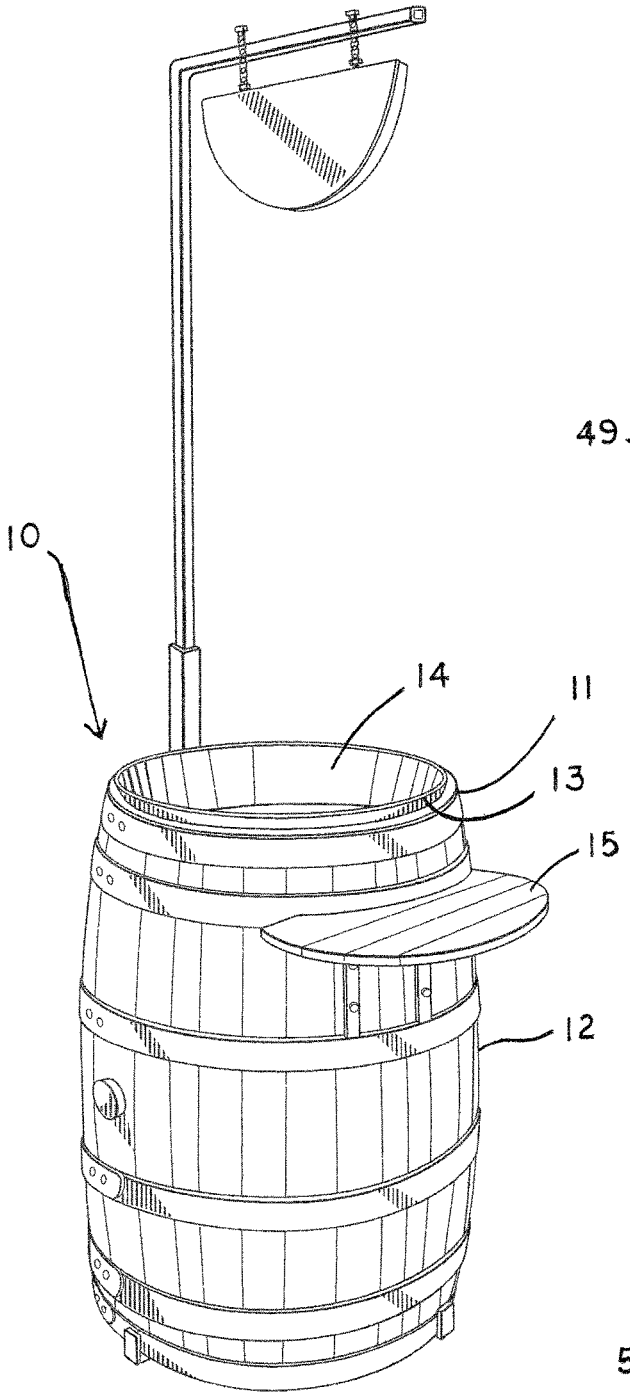
FIG. 1 is a perspective view of the classifier and concentrator sluice apparatus showing the shelf and support stand base and sign frame.
Figure 2:
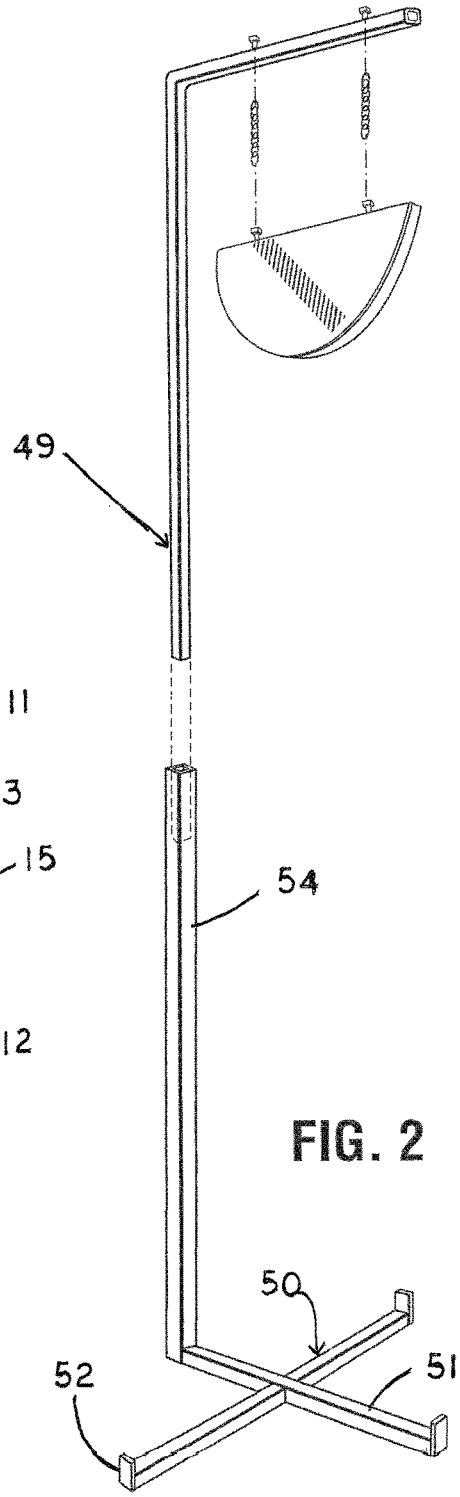
FIG. 2 is a perspective view of the support frame and base.
Figure 3:
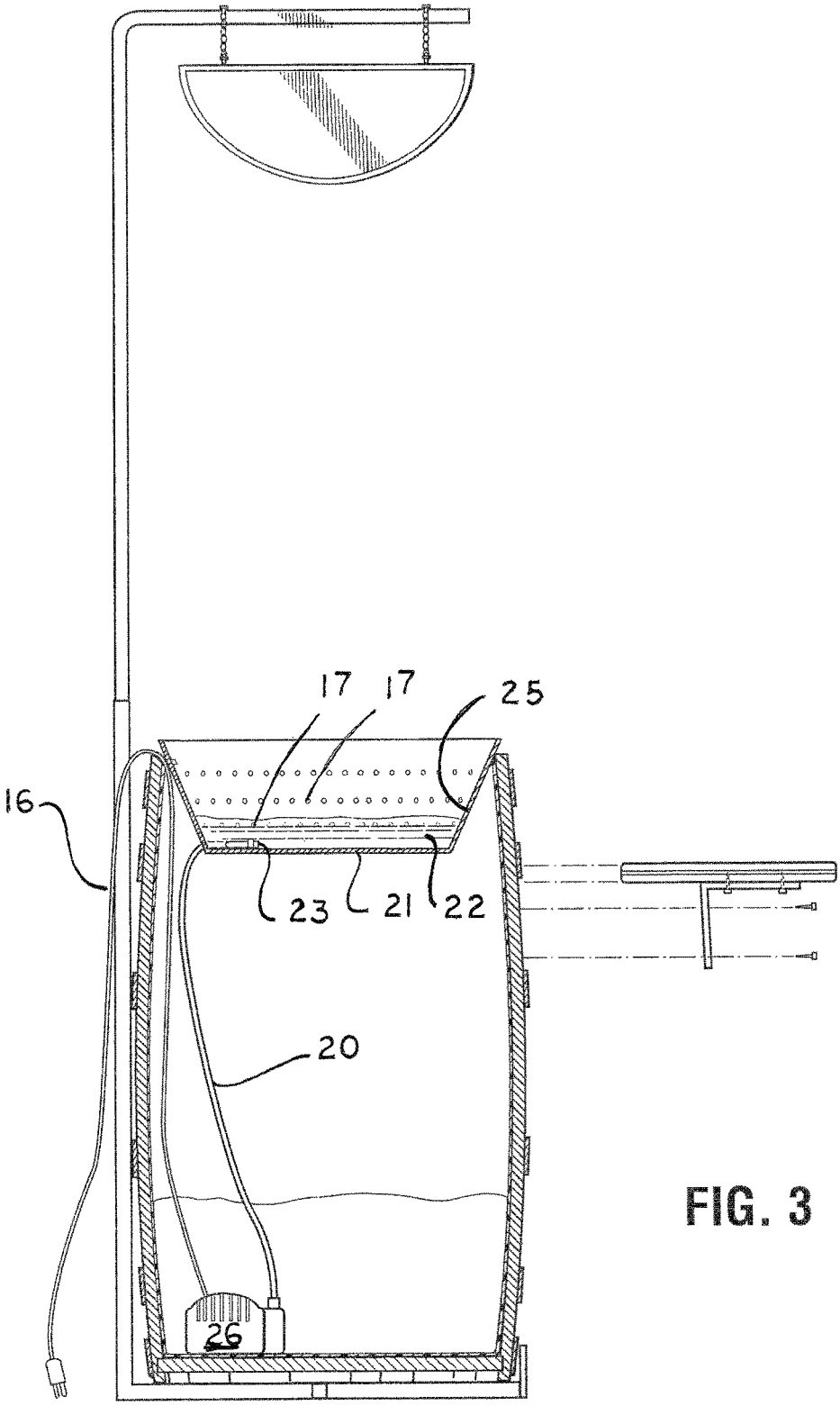
FIG. 3 is side view of the support frame and base, a sectional view of the classifier concentrator sluice apparatus barrel showing the water reservoir, pump and fluid conduits, a selected classifier tub having apertures therein, water level in the tub, aggregate in the bottom of the tub supported by the top edge of the barrel.

In accordance with the present invention, there is provided a classifier and concentrator sluice apparatus 10 including a barrel 12 sitting on the closed end and having an open top end 11, a header or washtub 14 sized so that the outer rim 13 rests in the top opening of the barrel 12, a recirculating submersible water pump 26 with an outlet hose 20 which passes through the bottom 21 of the washtub 14. As can be seen in the figures, the open end 23 of the hose 20 passes through the bottom of the washtub 14 near the outer wall 25 of the bottom of the washtub and is fastened along the bottom of the washtub lying near the wall so as to direct the flow of water around the bottom edge of the wall 13 of the washtub 14 in a swirling circular fashion. The other proximate end of the hose 20 is fastened to the output of the submersible water pump 26. It is intended that a plentiful supply of water remains in the bottom of the barrel reservoir for recirculation, and at least enough water to cover the submersible pump 26. The pump 26 is powered by a an electric cord or cable 16. A portable dc 12 volt water pump or 110 volt ac water pump may be used together with the necessary hoses and connectors to make the system complete. Battery power may provide a silent operation for a water recirculating concentrator in the field, home, hotel, or retail business.

The washtub 14 includes a plurality of spaced apart drainage holes 17 in the sidewall 13. The holes 17 are of a selected height of about ¼ inch to 3 inches, more preferably from ½ inch to about 2 inches and more preferably about one inch form the bottom of the washtub 12. There are preferably enough holes to prevent the water level from exceeding a level of about two inches over the bottom of the washtub while the pump is running. The water level can be regulated by adjusting the speed and/or flow rate from the pump, selection of size and depth of the tub and water holes, or both. The water flows through the drainage holes 17 and falls back into the bottom of the barrel 12 to then be re-circulated to the washtub. Water flows out of the flood header or wash tub containing perforations, over the smooth surface of the bottom or floor of the rubber tub. The aggregate feed material 22 is washed over a removable classifier screen for bank run type gravel. Moreover, the tubs may have a bottom surface formed of a mesh of a selected size, or circular sieve trays 24 or screens of selected mesh size may be used independently or in combination independently, nested tubs or trays 27, or stacked.

Different tubs can be used in addition to or instead of the primary tub in order to provides tubs with different size holes, a solid tub, or tubs having irregular surfaces such as lines, dimples of raised swirls 29 or grooves formed along the bottom in order to aid in separation of the ore.

Figure 4:
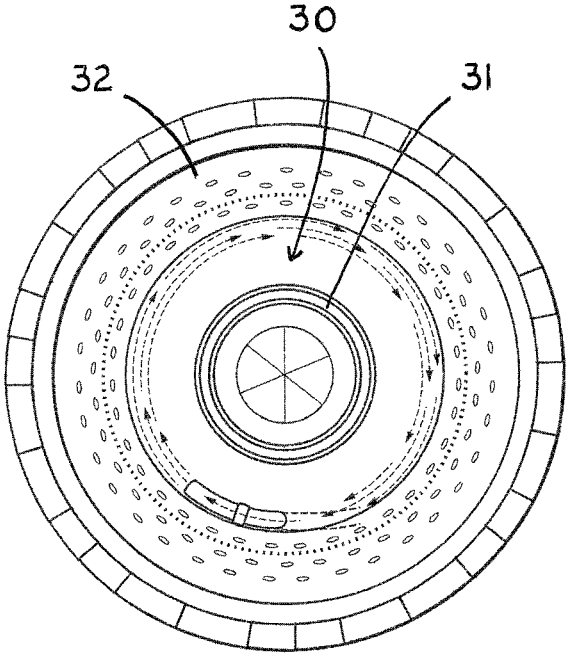
FIG. 4 is a top view of the classifier, separator, and/or concentrator barrel of FIG. 2 further including a pair of classifiers.
Figure 5:
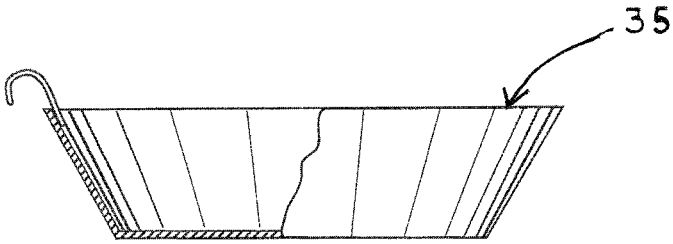
FIG. 5 is a side view showing a convenient tray for affixing to the outside edge of the barrel.
Figure 6:
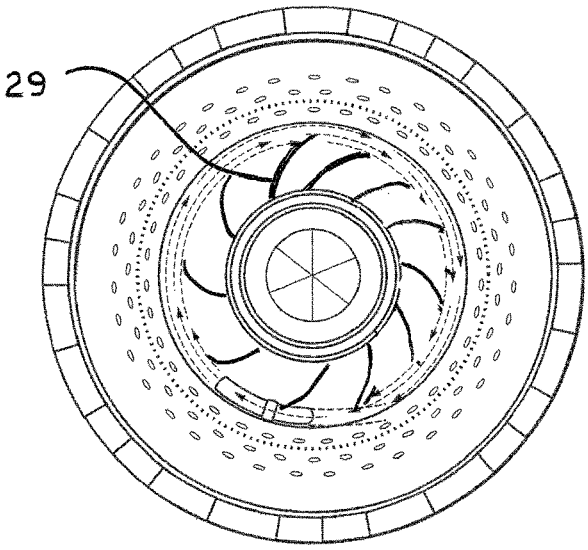
FIG. 6 is a top view of the classifier, separator, and/or concentrator barrel wherein the primary tub includes raised swirls.
Figure 7:
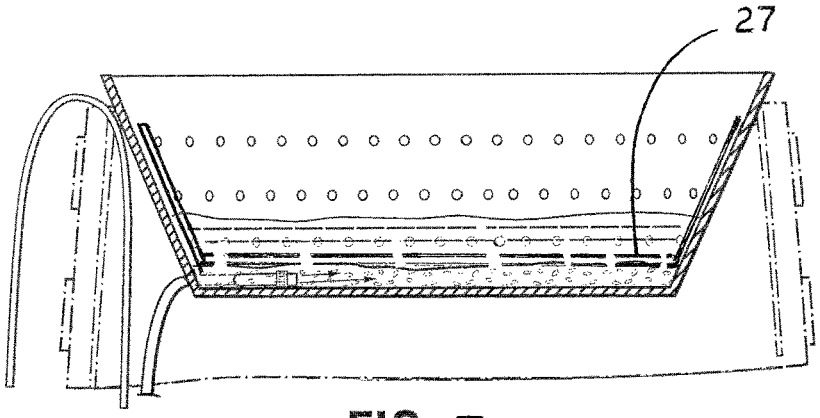
FIG. 7 is a cutaway side view of the barrel and tub showing a selected level of water therein below the discharge holes, the hose nozzle positioned adjacent the peripheral edge of the tube along the bottom and waste aggregate disposed in the center of the tub.
Figure 8:
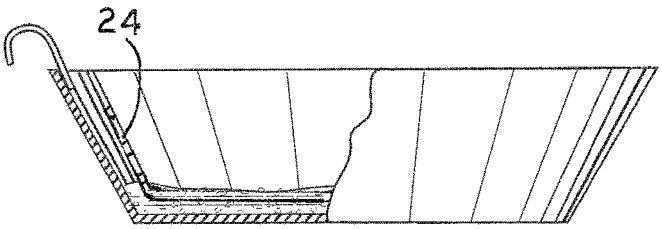
FIG. 8 is a sectional view showing the tub resting on the barrel sidewalls and the tub walls and bottom surface having holes in the side wall containing a sieve tray and water therein at a selected level, a supply line and recirculating line.

In the embodiment shown in FIG. 4, the self contained classifier, separator, and concentrator unit includes at least one and typically a plurality of classifier sieve trays 32 which may comprise a tube pan 30 with a generally straight inner side wall 31 and tapered outer sidewalls 32. Dirt or aggregate which has been searched in the washtub can be further searched by a sieve means such as a classifier. The classifier can be held in the stream of water exiting the hose 20 to aid in rinsing aggregate in the classifier. The classifier or colander is comprised of metal or plastic having openings such as holes or slots. For instance, a plastic classifier may have ½ square holes (#2 mesh) providing a sieve. Aluminum and/or stainless steel and/or plastic classifiers are commercially available with multiple mesh size options (2, 4, 8, 12, 20, 30, 50, 70 and 100).

The preferred embodiment of the invention includes a horizontal shelf 15 affixed to a side near the top edge of the barrel to hold tools, gold, ore, and other items used to process the ore.

It is anticipated that the indoor gold mining kit could be used to search through aggregate for other objects such as precious stones or small and heavy objects such as coins or small metallic objects.

Pans may be utilized in combination with the instant invention for separating small particles. It is also anticipated that the water may be directed to a circular downward sloping frame having a bottom connecting to sides and including a series of perpendicular spaced apart ridges providing a modified sluice to be used instead of or in combination with the classifier, concentrator and separator system of the present invention.

A convenient tray 35 may be affixed to the outside edge of the drum or barrel for holding the classifiers, feed aggregate, or product of the user.

A stand 49 may also be utilized which supports the inverted barrel or drum unit whereby a base 50 comprises a pair of cross members 51 having retaining means at the distal ends such as upturned flanges 52 for holding the barrel in position adjacent a vertical tubular or elongated mast 54 extending along the side of the barrel. The mast may terminate at a selected height above the barrel and bend at an angle or form a curve whereby an arm extends over the barrel above the base. A sign or other advertising display may be supported by the side arm 56.

The foregoing detailed description is given primarily for clearness of understanding and no unnecessary limitations are to be understood therefrom, for modification will become obvious to those skilled in the art upon reading this disclosure and may be made without departing from the spirit of the invention and scope of the appended claims. Accordingly, this invention is not intended to be limited by the specific exemplification presented herein above. Rather, what is intended to be covered is within the spirit and scope of the appended claims.

I claim:

1. A classifier and concentrator sluice apparatus, comprising:

a barrel sitting upright on a closed end with an open end at the top, said barrel including a water reservoir in a bottom portion thereof;

a washtub sized so that an outer rim of said washtub is supported by an outer rim of said open end of said barrel, a sidewall of said washtub having a plurality of holes formed therein, said holes being spaced apart and at least one inch above a bottom of said washtub;

a submersible water pump submersed in said water in said bottom of said barrel, said pump powered by a power cord connected to electricity entering from said open end of said barrel;

a water hose having a first end connected in fluid communication with an outlet of said submersible pump, a second end of said water hose passing through a bottom of said washtub near an outer edge of a bottom of said washtub, an open end of said water hose being fastened near said outer edge of said bottom of said washtub and horizontally along a bottom of said sidewall of said washtub; and at least one classifier of a selected mesh size for separating said aggregate according to the size of the particles, the classifier disposed in said washtub and exposed to circulating water therein for washing and separating said aggregate material.

2. The classifier and concentrator sluice apparatus of claim 1, including at tub selected from the group consisting of a tub including different size holes, a solid tub, an additional tub with different size holes.

3. The classifier and concentrator sluice apparatus of claim 2, said tub including an irregular surface selected from the group consisting of raised lines, dimples, raised swirls, and grooves formed along the bottom of said tub.

4. The classifier and concentrator sluice apparatus of claim 1, said tub including at least one classifier comprising a tube pan with a generally straight inner side wall and tapered outer sidewalls and having openings comprising holes therein.

5. The classifier and concentrator sluice apparatus of claim 2, said tub having holes selected from the group consisting of number 2 mesh, number 4 mesh, number 8 mesh, number 12 mesh, number 20 mesh, number 30 mesh, number 50 mesh, number 70 mesh and number 100 mesh.

6. The classifier and concentrator sluice apparatus of claim 2, said barrel including a horizontal shelf affixed to an outer surface near a top edge of said barrel.

7. The classifier and concentrator sluice apparatus of claim 1, further comprising a stand for supporting said barrel including a base having a pair of cross members adjacent a vertical elongated member extending along a side of said barrel terminating at a selected height above said barrel, said vertical elongated member including a top arm portion at extending at a selected angle over said barrel.

8. The classifier and concentrator sluice apparatus of claim 7, further including retaining means extending upward at a distal end of said cross member defining an upturned flange.

9. A classifier and concentrator sluice apparatus, comprising:

an inverted barrel sitting upright having a closed bottom end and an open top;

said barrel including a water reservoir having a selected volume of water in a bottom portion thereof;

a removable washtub coaxially fitting into said barrel whereby an outer rim of said barrel supports an outer rim of said washtub, said washtub including a plurality of spaced apart holes therein;

a submersible water pump submersed in said water reservoir powered by electricity and including a line for recirculating water from said water reservoir to a supply to an upper portion of said barrel, said water supply line having a distal end terminating at a peripheral edge of said washtub positioned at a selected depth and mounted generally at a selected position for circulating water along the outer edge of said washtub;

a water hose having a first end connected in fluid communication with an outlet of said submersible pump, a second end of said water hose passing through a bottom of said washtub near an outer edge of a bottom of said washtub, an open end of said water hose being fastened near said outer edge of said bottom of said washtub and horizontally along a bottom of said sidewall of said washtub for creating a circular flow within said tub; and at least one classifier of a selected mesh size for separating aggregate material placed in said classifier according to the size of the particles, said at least one classifier disposed in said washtub and exposed to circulating water therein for washing and separating said aggregate material.

10. The classifier and concentrator sluice apparatus of claim 9, wherein said tub includes a plurality of spaced apart drain holes located in a side wall of said tub at a selected depth above a bottom floor of said tub.

11. The classifier and concentrator sluice apparatus of claim 10, including a pressurized water nozzle spaced slightly above the bottom floor of said tub bottom at a selected position.

12. The classifier and concentrator sluice apparatus of claim 9, said tub walls including outwardly sloped sidewalls.

13. The classifier and concentrator sluice apparatus of claim 10, wherein said tub wall includes a plurality of openings formed in said tub wall spaced apart a selected distance from said floor of said tub and from one another extending around the circumference of said tube at different levels.

14. The classifier and concentrator sluice apparatus of claim 9, including at tub selected from the group consisting of a tub including different size holes, a solid tub, an additional tub with different size holes.

15. The classifier and concentrator sluice apparatus of claim 9, said tub including an irregular surface selected from the group consisting of raised lines, dimples, raised swirls, and grooves formed along the bottom of said tub.

16. The classifier and concentrator sluice apparatus of claim 9, said tub including at least one classifier comprising a tube pan with a generally straight inner side wall and tapered outer sidewalls and having openings comprising holes therein.

17. The classifier and concentrator sluice apparatus of claim 14, said tub having holes selected from the group consisting of number 2 mesh, number 4 mesh, number 8 mesh, number 12 mesh, number 20 mesh, number 30 mesh, number 50 mesh, number 70 mesh and number 100 mesh.

18. The classifier and concentrator sluice apparatus of claim 9, said barrel including a horizontal shelf affixed to an outer surface near a top edge of said barrel.

19. The classifier and concentrator sluice apparatus of claim 9, further comprising a stand for supporting said barrel including a base having a pair of cross members adjacent a vertical elongated member extending along a side of said barrel terminating at a selected height above said barrel, said vertical elongated member including a top arm portion at extending at a selected angle over said barrel and further including retaining means extending upward at a distal end of said cross member defining an upturned flange.

* * * * *